United States Patent [19]

Norimatsu

[11] Patent Number: 4,977,813

[45] **Date of Patent: * Dec. 18, 1990**

[54] ELECTRONIC MUSICAL INSTRUMENT HAVING PLAYING AND PARAMETER ADJUSTMENT MODE

[75] Inventor: Takashi Norimatsu, Shizuoka, Japan

[73] Assignee: Yamaha Corporation, Hamamatsu, Japan

[ * ] Notice: The portion of the term of this patent subsequent to Oct. 17, 2006 has been disclaimed.

[21] Appl. No.: 397,908

[22] Filed: Aug. 24, 1989

Related U.S. Application Data

[62] Division of Ser. No. 184,602, Apr. 21, 1988, Pat. No. 4,873,904.

[30] Foreign Application Priority Data

Apr. 22, 1987 [JP] Japan ..... 62-100772
Apr. 22, 1987 [JP] Japan ..... 62-100773
Apr. 22, 1987 [JP] Japan ..... 62-100774

[51] Int. Cl.[5] ..... G10H 3/18

[52] U.S. Cl. ..... 84/722; 84/723; 84/DIG. 30

[58] Field of Search ..... 84/646, 722–724, 84/731, DIG. 30

[56] References Cited

U.S. PATENT DOCUMENTS 3,562,399 2/1971 Yamauchi et al. .
3,902,395 9/1975 Avant .
4,292,875 10/1981 Nourney .
4,321,852 3/1982 Young, Jr. .
4,516,462 5/1985 Schulze .
4,567,805 2/1986 Clevinger .
4,630,520 12/1986 Bonanno .
4,653,376 3/1987 Allured et al. .
4,658,690 4/1987 Aiken et al. .
4,669,482 6/1987 Ophir .
4,676,134 6/1987 Newell .
4,702,141 10/1987 Bonanno .
4,723,468 2/1988 Takabayashi et al. ..... 84/722
4,748,887 6/1988 Marshall .
4,794,838 1/1989 Corrigau, III .
4,817,484 4/1989 Iba et al. .
4,873,904 10/1989 Norimatsu .

FOREIGN PATENT DOCUMENTS 8502705 6/1985 European Pat. Off. .
288062 10/1988 European Pat. Off. .
3108865 2/1983 Fed. Rep. of Germany .
63-249196 3/1987 Japan .

*Primary Examiner*—Stanley J. Witkowski
*Attorney, Agent, or Firm*—Burns, Doane, Swecker & Mathis

[57] ABSTRACT

An electronic musical instrument having a parameter adjustment mode and playing mode of operation includes a plurality of fret members located at predetermined spacings, a string stretched over the fret members so that a player's depression of the string causes contact between the string and at least one of the first members, and a vibration generating and receiving means for producing supersonic vibrations having a variable waveform in the string and receiving the supersonic vibrations reflected from any of the fret members through the string. The supersonic vibrations transmitted from the vibration generating and receiving means are reflected from a fret member contacted by the string, so that the vibration generating and receiving means detects transmitting characteristics of the string when a parameter adjustment mode is selected. Further, data forming means form data representing the transmitting characteristics of the string, and fret position detecting means are responsive to data supplied by the data forming means for detecting the fret member contacted by the string when a playing mode of operation is selected.

1 Claim, 8 Drawing Sheets

ELECTRONIC MUSICAL INSTRUMENT HAVING PLAYING AND PARAMETER ADJUSTMENT MODE

This application is a divisional of U.S. application Ser. No. 07/184,602, filed on Apr. 21, 1988, now U.S. Pat. No. 4,873,904.

FIELD OF THE INVENTION

The present invention relates to an electronic sound-producing system including a musical instrument of the fretted and stringed type in addition to a signal controlled tone generator. More particularly, the present invention relates to a fretted and stringed musical instrument to form part of such a sound-producing system. An electric or electronic musical instrument to which the present invention appertains is of the fretted and stringed type and may thus be by way of example of the guitar, mandolin, banjo, balalaika or lute type.

BACKGROUND OF THE INVENTION

With a fretted and stringed electric or electronic musical instrument, musical sound is produced with various tones generated through detection of the timings at which strings are picked and the locations of the fret members against which the strings being picked are pressed on the fingerboard. The timing at which a string is picked can be detected by the use of an electromagnetic pickup device responsive to relatively low frequency vibrations of the string. On the other hand, the location of the fret member with which a string is pressed into contact is detected by a fret-position detector using piezoelectric transducer elements respectively engaging the strings of the musical instrument. Each of the piezoelectric transducer elements is electrically activated to produce supersonic vibrations in the associated string and the supersonic vibrations thus produced in the string are transmitted to the fret member with which the string is currently pressed into contact. The vibrations which have reached the particular fret member are then reflected from the fret member and are transmitted backwardly to the piezoelectric transducer element. The supersonic vibrations returned to the piezoelectric transducer element mechanically activate the transducer element to produce an electric output signal when the vibrations are received by the transducer element. The signal thus produced by the piezoelectric transducer element is monitored to determine the time interval intervening between the generation of the supersonic vibrations in the sound and the generation of the signal by the supersonic vibrations returned to the transducer element. An electronic musical instrument of this type is disclosed in U.S. Pat. No. 4,723,468.

The fret-position detector used in a prior-art electronic musical instrument of the described type depends for its operation on the period of time for which supersonic vibrations are transmitted to and from a fret member. For this reason, it is of critical importance for the reliability of operation of the instrument that the supersonic vibrations echoed from the fret member be strictly discriminated from various spurious vibrations which may be transmitted to the piezoelectric transducer element to act as noises to the echoed signal vibrations. The spurious vibrations which may be transmitted to the piezoelectric transducer element include vibrations echoed from a bridge member carrying the piezoelectric transducer elements of the fret-position detector per se. Such spurious vibrations are produced in the bridge member in direct response to the supersonic vibrations generated in the transducer elements and are reflected from the bridge member directly to each of the transducer elements.

To eliminate the effects of such noise vibrations which may be transmitted to the piezoelectric transducer elements of the fret-position detector, the electric output signal produced by each of the transducer elements is analyzed to detect the cyclically occurring peaks of the signal waveform and determine the time interval intervening between successive two of the peaks detected. A problem still arises in this manner of detecting the fret positions because, primarily, the peaks of the signal waveform produced by the fretposition detector are subject to irregular variation depending on the conditions in which the the string through which the supersonic vibrations are transmitted is held in contact with the fret member to which the vibrations are transmitted. Such irregular variation in the peaks of the signal waveform may cause an error in the time interval determined on the basis of the signal from the fret-position detector. When such an error is grown to a critical degree after the instrument is used for an extended period of time, deviation may be caused between the note of the sound intended to be produced by the player of the instrument and the note of the sound actually produced by the instrument in response to the signal from the fret-position detector.

The present invention first contemplates elimination of these drawbacks of a prior-art electronic musical instrument using a known fret-position detector. It is, accordingly, an important object of the present invention to provide an electronic musical instrument in which the location of the fret member with which a string being picked is pressed into contact can be accurately determined without respect to the spurious vibrations which may be transmitted to the piezoelectric transducer elements of the fret-position detector included in the instrument.

There is another important problem which results from the fact that the fret-position detector depends for its operation on the time interval for which supersonic vibrations are transmitted to and from a fret member. Such a time interval is however subject to fluctuations due to deformation of the neck portion of the instrument as caused by the tensions maintained in the strings and to lateral displacement of the strings on the fret members. In case such fluctuations in the time interval are of a critical degree, deviation may also be caused between the note of the sound intended to be produced by the player of the instrument and the note of the sound actually produced by the instrument in response to the signal from the fret-position detector.

Thus, the present invention further contemplates elimination of such a drawback of a prior-art electronic musical instrument using a known fret-position detector. Accordingly, it is another important object of the present invention to provide an electronic musical instrument capable of accurately determining the location of a fret member without respect to the fluctuations which may be caused in the time interval determined by the fret-position detector included in the instrument.

In the meantime, there is known and used a "bent-string" playing technique with which a string is forced to sidewise slide on a fret member to produce a rising intonation. When such a technique is used during playing of a musical instrument having a fret-position sensor of the described nature, the sensor could not detect the mode of playing and for this reason the sound producing system could not produce the player's intended rising intonation. This is primarily because of the fact that the sensor depends for its operation merely on the period of time for which vibrations are transmitted to a fret member and backwardly from the fret member to the sensor. To eliminate such an inconvenience, an electronic musical instrument has been proposed which uses probe elements respectively held in engagement with the individual strings of the instrument. Each of the probe elements is located to intercept the path of light in a photocoupling unit which thus produces an electric signal variable with the lateral displacement of the string engaged by the associated probe element. An electronic musical instrument of this type is disclosed in Japanese Patent Application No. 62-083289.

The features of these two types of prior-art musical instruments could be combined to provide an electronic musical instrument allowing the player of the instrument to use the bent-string playing technique. In such an electronic musical instrument having the combined features of the two types of prior-art instruments, the signal produced from the photo-coupling unit is produced upon comparison with a signal produced when the associated string remains in a non-bent state extending straight on a fret member. It is thus of critical importance that the value of the signal produced responsive to a string in such a non-bent state be accurately determined by the photocoupling unit. Difficulties are however encountered in accurately determining such a value because, primarily, of the fact that the lateral position of each string on a fret member is subject to variation depending on the tension in the string.

The present invention further contemplates elimination of such a drawback of an electronic musical instrument having the combined features of the two types of prior-art instruments. It is, accordingly, still another important object of the present invention to provide an improved electronic musical instrument having a bent-string sensor and capable of accurately determining a non-bent state of a string.

SUMMARY OF THE INVENTION

In accordance with one aspect of the present invention, these and other objects are accomplished in an electronic musical instrument having a parameter adjustment mode and playing mode of operation, comprising a plurality of fret members located at predetermined spacings; a string stretched over said fret members so that a player's depression of the string causes contact between the string and at least one of said fret members; vibration generating and receiving means for producing supersonic vibrations having a variable waveform in said string and receiving the supersonic vibrations reflected from any of said fret members through said string, the supersonic vibrations transmitted from said vibration generating and receiving means being reflected from a fret member contacted by said string, so that said vibration generating and receiving means detect transmitting characteristics of said string when a parameter adjustment mode is selected; data forming means for forming data representing said transmitting characteristics of said string; and fret position detecting means responsive to said data supplied by said data forming means for detecting said fret member contacted by said string when a playing mode of operation is selected.

SUMMARY OF THE INVENTION

Further, these and other objects are accomplished in an electronic musical instrument having a parameter adjustment mode and a playing mode of operation, comprising (a) a plurality of fret members located at predetermined spacings; (b) a string stretched over the fret members and engageable to any of the fret members; (c) vibration generating and receiving means for producing supersonic vibrations in the string and receiving the supersonic vibrations reflected from any of the fret members through the string, the supersonic vibrations transmitted from the vibration generating and receiving means being reflected from a fret member engaged by the string; and (d) fret-position detecting means responsive to the supersonic vibrations transmitted from and reflected to the vibration generating and receiving means for detecting the fret member engaged by the string, the fret-position detecting means comprising means for detecting the waveform of the supersonic vibrations reflected to the vibration generating and receiving means, means for detecting a peak value of the waveform, means for determining a threshold value in respect of the string during the parameter adjusting mode of operation, memory means for storing the threshold value during, and means for comparing a peak value detected from the waveform with the threshold value during the playing mode of operation for determining whether or not the waveform is of the supersonic vibrations reflected from any of the fret members.

Further, there is provided an electronic musical instrument having a parameter adjustment mode and a playing mode of operation, comprising (a) a plurality of fret members located at predetermined spacings; (b) a string stretched over the fret members and engageable to any of the fret members; (c) vibration generating and receiving means for producing supersonic vibrations in the string and receiving the supersonic vibrations reflected from any of the fret members through the string, the supersonic vibrations transmitted from the vibration generating and receiving means being reflected from a fret member engaged by the string; and (d) fret-position detecting means responsive to the supersonic vibrations transmitted from and reflected to the vibration generating and receiving means for detecting the fret member engaged by the string, the fret-position detecting means comprising memory means for storing data representative of a reference time interval for which the supersonic vibrations are transmitted from and reflected to the vibration generating and receiving means in respect to each of the fret members during the parameter adjusting mode of operation, first detecting means for detecting the time interval for which the supersonic vibrations are transmitted from and reflected to the vibration generating and receiving means during the playing mode of operation, means for comparing the time interval detected by the first detecting means with the reference time interval during the playing mode of operation for thereby determining the fret member from which the supersonic vibrations are reflected to the vibration generating and receiving means, second detecting means for detecting the time interval for which the supersonic vibrations are transmitted from and reflected to the vibration generating and receiving means in respect of a selected one of the fret members during the parameter adjusting mode of operation, and means for producing time interval data on the basis of the time interval detected by the second detecting means and storing the time interval data into the memory means.

There is further provided an electronic musical instrument having a parameter adjustment mode and a playing mode of operation, comprising (a) a plurality of fret members located at predetermined spacings; (b) a string stretched over the fret members and engageable to any of the fret members, (c) vibration generating and receiving means for producing supersonic vibrations in the string and receiving the supersonic vibrations reflected from any of the fret members through the string, the supersonic vibrations transmitted from the vibration generating and receiving means being reflected from a fret member engaged by the string; (d) fret-position detecting means responsive to the supersonic vibrations transmitted from and reflected to the vibration generating and receiving means for detecting the fret member engaged by the string; (e) string displacement detecting means for detecting an amount of lateral displacement of the string on any of the fret members and producing data representative of the detected amount of lateral displacement of the string; (f) memory means for storing the data representative of the amount of lateral displacement detected with the string maintained in a non-bent state; and (g) means for comparing the amount of lateral displacement of the string from the data produced by the string displacement detecting means during the playing operation with the data stored in the memory means for thereby producing bent-string data representative of a corrected amount of lateral displacement of the string.

BRIEF DESCRIPTION OF THE DRAWINGS

The features and advantages of a musical instrument according to the present invention will be more clearly understood from the following description taken in conjunction with the accompanying drawings in which.

DESCRIPTION OF THE PREFERRED EMBODIMENT

The general arrangement of a preferred embodiment of a musical instrument according to the present invention will now be described in more detail with reference to FIG. 1. The musical instrument herein shown is of the guitar type but may be understood to be representative of a fretted and stringed electric or electronic musical instrument of any of the types hereinbefore enumerated.

Figure 1:
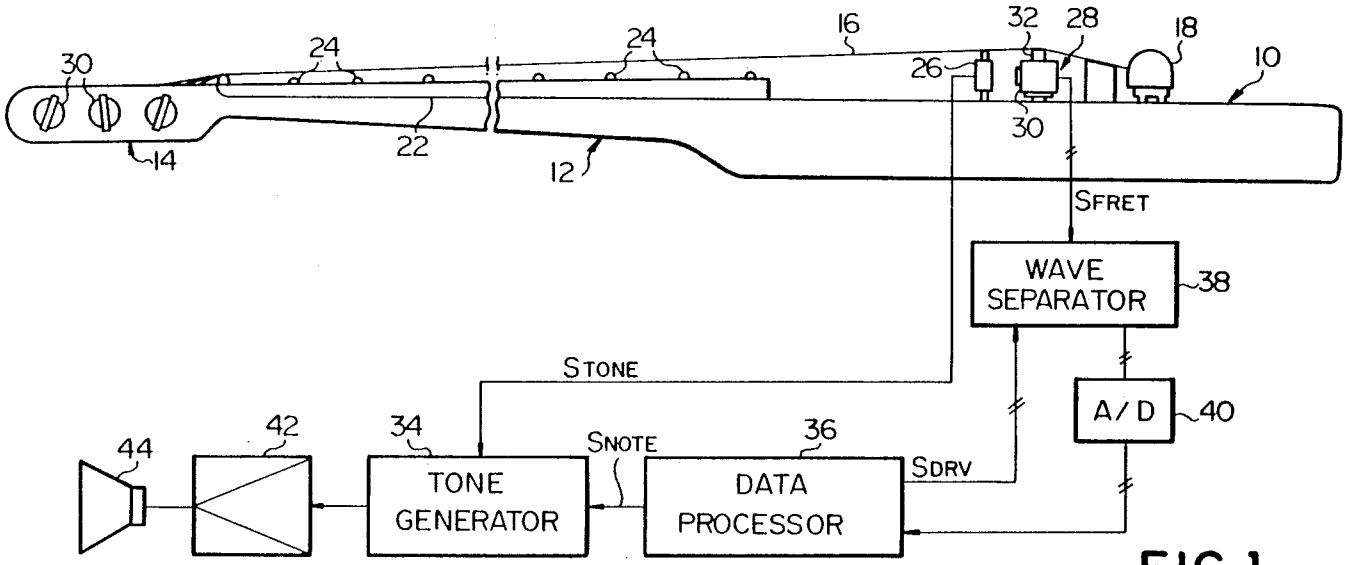
FIG. 1 shows in a side elevation view a preferred embodiment of a fretted and stringed electronic musical instrument according to the present invention and in a block diagram the general circuit arrangement of the control system incorporated in the musical instrument.

Referring to FIG. 1, the musical instrument of the guitar type embodying the present invention comprises a body portion 10, a neck portion 12 extending forwardly from the body portion 10, and a head portion 14 further extending forwardly from the neck portion 12. A plurality of or typically six strings 16 are anchored each at one end to a tailpiece 18 fixedly attached to the body portion 10 and have leading end portions rolled round tuning pegs 20 fitted to the head portion 14 to permit adjustment of the tension in each of the strings 16. On the neck portion 12 of the instrument is mounted a fingerboard 22 on which a plurality of fret members 24 are located at predetermined spacings from one another.

The musical instrument further comprises a tone detector assembly 26 composed of a plurality of electromagnetic pickup elements respectively corresponding to the strings 16. Each of the pickup elements of the tone detector assembly 26 is responsive to the vibrations of relatively low frequencies of the associated one of the strings 16 and, when the associated string 16 is picked by the player of the instrument, produces an output signal $S_{TONE}$ indicative of the string 16 currently picked by the player and the time for which the particular string 16 is being picked.

The tone detector assembly 26 forms part of a control system of the musical instrument embodying the present invention, which control system further comprises a fret-position detector assembly 28 including a bridge member 30 fixedly attached to and extending laterally of the body portion 10 of the instrument. On the bridge member 30 are mounted a plurality of piezoelectric transducer elements 32 which are arranged along the bridge member 30 to correspond to the individual strings 16, respectively.

The pickup elements of the tone detector assembly 26 are electrically connected to a tone generator circuit 34 which generates musical tones in response to the signals $S_{TONE}$ respectively supplied from the pickup elements. On the other hand, the piezoelectric transducer elements 32 of the fret-position detector assembly 28 are electrically connected to a data processor circuit 36 through a wave separator circuit 38 or through the wave separator circuit 38 and an analog-to-digital (A/D) converter 40. The data processor circuit 36 is further connected to the tone generator circuit 34, which in turn is connected through an amplifier 42 to a sound system 44 which may be implemented by a speaker unit.

From the data processor circuit 36 is supplied a succession of driving pulses $S_{DRV}$ to each of the piezoelectric transducer elements 32 through the wave separator circuit 38. Each time a driving pulse $S_{DRV}$ is supplied to the piezoelectric transducer elements 32, each of the transducer elements 32 is electrically activated to generate vibrations of a predetermined supersonic (or ultra-audible) frequency of, for example, 450 KHz. The supersonic-frequency vibrations thus generated by each piezoelectric transducer element 32 are transmitted through the string 16 corresponding to the piezoelectric transducer element 32 to the fret member 24 with which the particular string 32 is pressed into contact. The vibrations which have reached the fret member 24 are then reflected or "echoed" backwardly from the fret member 24 to the piezoelectric transducer element 32 and enable the transducer element 32 to produce an electric signal $S_{FRET}$ when the vibrations reflected from the fret member 24 are received by the transducer element 32. The electric signal $S_{FRET}$ thus produced by each of the piezoelectric transducer elements is supplied in digitalized form to the data processor circuit 36 through the wave separator circuit 38 and by way of the analog-to-digital converter 40. As noted previously, each of the piezoelectric transducer elements 32 receives not only the supersonic vibrations echoed from the fret member 24 but also the spurious vibrations produced in the bridge member 30 in direct response to the supersonic vibrations generated in the transducer elements 32 and reflected from the bridge member 30 further directly to each of the transducer elements 32.

From the electric signal $S_{FRET}$ supplied from each of the piezoelectric transducer elements 32, the data processor circuit 36 detects the time duration for which the supersonic vibrations originating in the piezoelectric transducer element 32 have travelled from the transducer element 32 to the fret member 24 and backwardly from the fret member 24 to the transducer element 32. The time duration is variable with the distance of the fret member 24 from the piezoelectric transducer element 32 and is accordingly representative of the location of the fret member 24 with respect to the transducer element 24. The location of the fret member 24 pressed upon by a string 16 is in this manner detected from the electric signal $S_{FRET}$ supplied from each of the piezoelectric transducer elements 32 respectively associated with the individual strings 16.

In this manner the data processor circuit 36 produces a sound note signal $S_{NOTE}$ indicative of the note of the sound to be generated for each of the strings 16 and supplies the signal $S_{NOTE}$ to the tone generator circuit 34. In response to the signal $S_{NOTE}$ indicative of the note of the sound to be generated and the signal $S_{TONE}$ indicative of the timing at which the sound is to be produced, the tone generator circuit 34 determines the sound to be generated with the particular note and at the particular timing. The tone generator circuit 34 then supplies an appropriate driver signal to the sound system 44 upon amplification by the amplifier 42 connected to the sound system 44.

Figure 2:
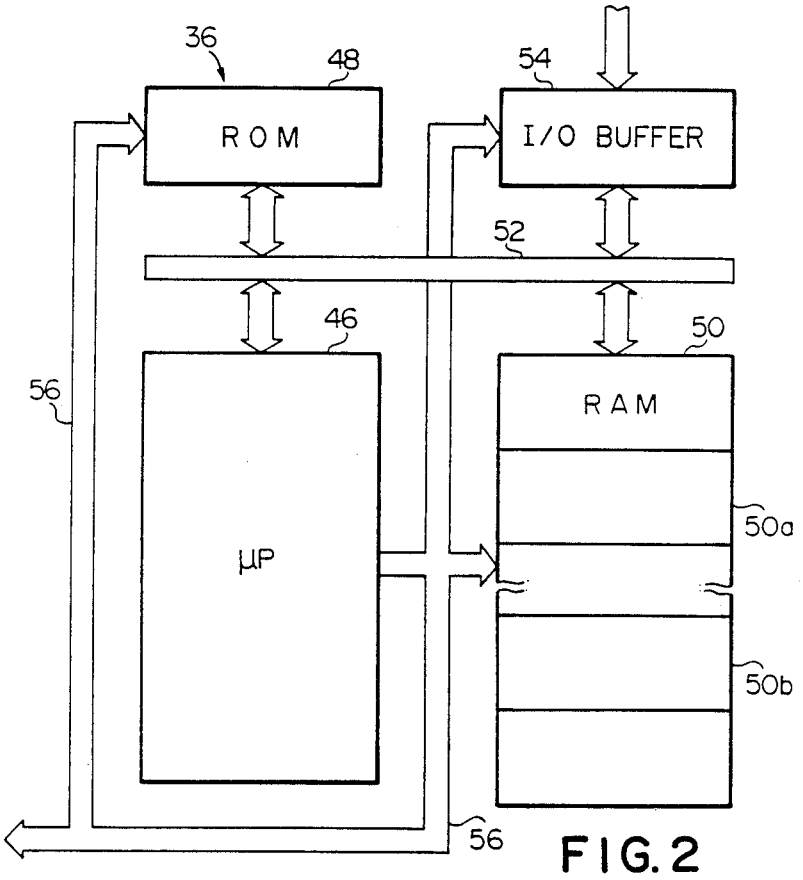
FIG. 2 is a plan view showing an example of the general configuration of the data processor circuit which forms part of the control system of the musical instrument embodying the present invention.

FIG. 2 shows an example of the general configuration of the data processor circuit 36 which forms part of the control system of the musical instrument embodying the present invention.

As shown, the data processor circuit 36 comprises a microprocessor unit 46, a read-only memory (ROM) unit 48 storing a set of instructions for the program to be executed by the microprocessor unit 46, and a random-access memory (RAM) unit 50 for storing the data produced in or received by the microprocessor unit 46. These microprocessor unit 46, ROM unit 48 and RAM unit 50 are connected together through a data bus 52 through which instructions are to be accessed in the ROM unit and transmitted to the microprocessor unit 46 or data are to be transmitted from the microprocessor unit to the RAM unit 50. The data bus 52 is further connected through an input/output (I/O) buffer 52 to the tone generator circuit 34, wave separator circuit 38 and A/D converter 40 so that data may be exchanged between each of these circuits 34, 38 and 40 and the microprocessor unit 46 through the bus 52 and by way of the I/O buffer 52. Address signals are to be supplied from the microprocessor unit 46 to each of the ROM unit 48, RAM unit 50 and I/O buffer 54 through an address bus 56.

The RAM unit 50 has memory areas 50*a* and 50*b* reserved for storing data for use detecting the locations of the fret members 24 onto which the strings 16 being picked are pressed. Such data include threshold values calculated by the microprocessor unit 46 in respect of the individual strings 16, respectively, of the instrument and stored in the memory area 50*a*. In the other memory area 50*b* are stored fret position data indicating the locations of the fret members 24 in terms of the time intervals for which supersonic vibrations are transmitted from and reflected to the piezoelectric transducer elements 32.

A routine program which may be executed by the microprocessor unit 46 to achieve the major function of the electronic musical instrument embodying the present invention will be hereinafter described with reference to the flowchart of FIG. 3.

Figure 3:
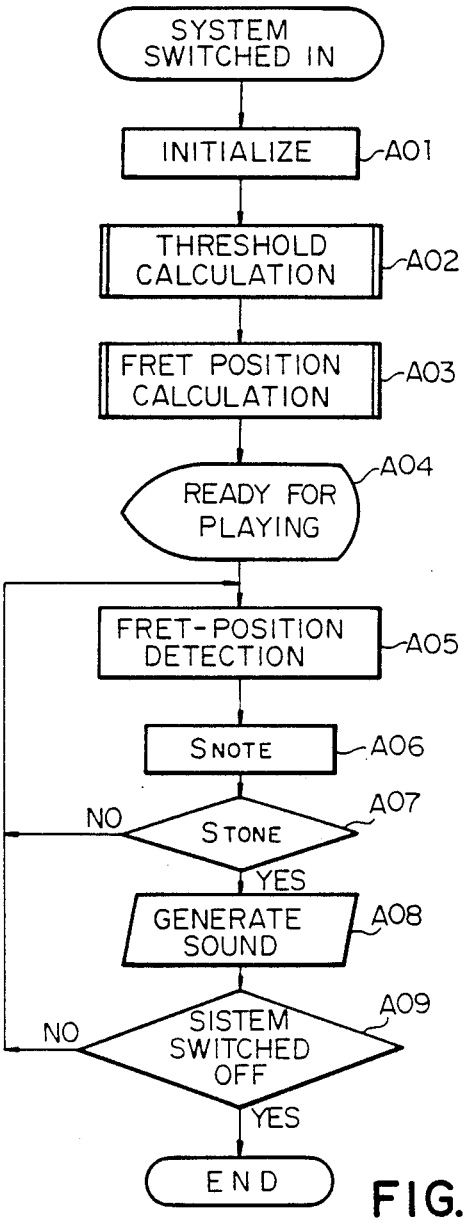
FIG. 3 is a flowchart showing a main routine program which may be executed to achieve the major function of the first preferred embodiment of an electronic musical instrument according to the present invention.

The microprocessor unit 46 starts the execution of the main routine program shown in FIG. 3 when the system is initially switched in and at step A01 initializes the whole system in accordance with the instructions stored in the ROM unit 48. After the whole system is thus initialized, the microprocessor unit 46 proceeds to a threshold calculating subroutine program A02 to determine threshold values ($V_T$) for the individual strings 16, respectively, and store the threshold values into the memory area 50*a* of the RAM unit 50. The details of this threshold calculating subroutine program A02 will be hereinafter described with reference to FIG. 4.

Upon termination of the threshold calculating subroutine program A02, the microprocessor unit 46 proceeds to a fret-position calculating subroutine program A03 to determine fret position data indicating the locations of the fret members 24 in terms of the time intervals for which supersonic vibrations are transmitted from and reflected to the piezoelectric transducer elements 32. The fret-position calculating subroutine program A03 is followed by a step A04 to indicate that the instrument is ready to operate. Such an indication may be given by the glowing or flickering of any light emitter element (not shown) such as a light emitting diode (LED) provided on the instrument. The step A01 and subroutine programs A02 and A03 provide a parameter adjustment mode of operation of the instrument. The microprocessor unit 46 then proceeds to a loop of steps which provide a playing mode of operation of the instrument.

During the playing mode of operation of the instrument, the microprocessor unit 46 executes a fret-position detecting subroutine program A05 in accordance with any instructions fetched from the ROM unit 468. In this fret-position detecting subroutine program A05, the microprocessor unit 46 supplies driving pulses $S_{DRV}$ successively to each of the piezoelectric transducer elements 32 of the fret-position detector assembly 28 through the wave separator circuit 38 shown in FIG. 1. Each time a driving pulse $S_{DRV}$ is thus supplied to the piezoelectric transducer elements 32 concurrently, each of the transducer elements 32 is electrically activated to generate supersonic vibrations. The supersonic vibrations thus generated by each piezoelectric transducer element 32 are transmitted through the string 16 engaged by the piezoelectric transducer element 32 to the fret member 24 with which the particular string 32 is pressed into contact. The vibrations which have reached the fret member 24 are then reflected or echoed backwardly from the fret member 24 to the piezoelectric transducer element 32 and enable the transducer element 32 to produce an analog electric signal $S_{FRET}$ when the vibrations reflected from the fret member 24 are returned to the transducer element 32.

Simultaneously when a driving pulse $S_{DRV}$ is issued from the microprocessor unit 46, the internal timer of the microprocessor unit 46 starts the counting of time and continues the counting of time until the supersonic vibrations echoed from any of the fret members 24 are received by the piezoelectric transducer element 32 in which the supersonic vibrations originated. As noted previously, the vibrations which are received by the piezoelectric transducer element 32 contain not only the supersonic vibrations echoed from the fret member 24 but the spurious vibrations reflected from the bridge member 30 forming part of the fret-position detector assembly 28 per se. Such spurious vibrations are generated in the bridge member 30 in direct response to the supersonic vibrations generated in the transducer elements 32 and reflected from the bridge member 30 further directly to each of the transducer elements 32.

The analog electric signal $S_{FRET}$ produced by each of the piezoelectric transducer elements 32 is passed through the wave separator circuit 38 to the A/D converter 40. A series of digital signals is produced by the A/D converter 50 from the analog signals $S_{FRET}$ respectively output from the piezoelectric transducer elements 32 associated with the individual strings 16 are supplied in succession to the microprocessor unit 46 of the data processor circuit 36 through the I/O buffer 54. Until the supersonic vibrations transmitted from the piezoelectric transducer element 32 of the fret-position detector assembly 28 are reflected from any of the fret members 24 and are received by the transducer elements 32, the piezoelectric transducer element 32 is therefore responsive only to the vibrations echoed from the bridge member 30. The analog output signal $S_{FRET}$ from the piezoelectric transducer element 32 is variable voltage with the waveform of the vibrations received by the transducer element 32 and, thus, the series of digital signals converted therefrom is variable with the voltage of the signal $S_{FRET}$.

In response to each of the digital signals successively input through the I/O buffer 54, the microprocessor unit 46 reads the threshold value stored in the memory area 50*a* of the RAM unit 50 in respect of the string 16 associated with the particular piezoelectric transducer element 32 and compares the data represented by the received digital signal with the threshold value thus read from the RAM unit 50. In the absence of any supersonic vibrations reflected from the fret member 24, the digital signal which has resulted from the supersonic vibrations echoed from the bridge member 30 can be easily and accurately discriminated from the digital signal which may otherwise be produced in response to the supersonic vibrations reflected from the fret member 24. The digital signal resulting from the vibrations reflected from the bridge member 30 is thus rejected effectively as a result of the comparison thus made between the digital signal and the threshold value read from the RAM unit 50.

In the meantime, the supersonic vibrations transmitted to and reflected from any of the fret members 24 will return to the piezoelectric transducer element 32. At the point of time such vibrations are received by the piezoelectric transducer element 32, the internal timer of the microprocessor unit 46 ceases the counting of time whereupon the microprocessor unit 46 calculates the period of time which has lapsed since the vibrations were initially generated in the piezoelectric transducer element 32. The data thus produced as representing such a time interval is compared with a fret position data fetched from the memory area 50*b* of the RAM unit 50 to specifically determine the fret member 24 from which the supersonic vibrations have been reflected, viz., with which the string 16 associated with the piezoelectric transducer element 32 is currently held in contact.

After the fret member 24 against which the string 16 associated with each of the piezoelectric transducer elements 32 is currently held in contact is determined as above described, the microprocessor unit 46 proceeds to a sound note signal output step A06 to output the signal $S_{NOTE}$ indicative of the note of the sound to be generated for each of the strings 16. The sound note signal $S_{NOTE}$ thus produced by the microprocessor unit 46 is output from the data processor circuit 36 to the tone generator circuit 34 through the I/O buffer 54. It is then tested at step A07 whether or not there is the signal $S_{TONE}$ supplied from the tone detector assembly 26 to the tone generator circuit 34. If it is found at the step A07 that there is such a signal produced with any of the strings 16 picked by the player, the microprocessor unit 36 of the data processor circuit 36 supplies the sound note signal $S_{NOTE}$ to the tone generator circuit 34. In response to the signal $S_{NOTE}$ indicative of the note of the sound to be generated and the signal $S_{TONE}$ indicative of the timing at which the sound is to be produced, the tone generator circuit 34 determines the sound to be generated with the particular note and at the particular timing. The tone generator circuit 34 then supplies at step A08 an appropriate driver signal to the sound system 44 upon amplification by the amplifier 42 connected to the sound system 44. Thereafter, the loop of the steps A04 to A08 which dictate the playing mode of operation of the instrument is repeated until it is found at step A09 that the system is switched off.

Figure 4:
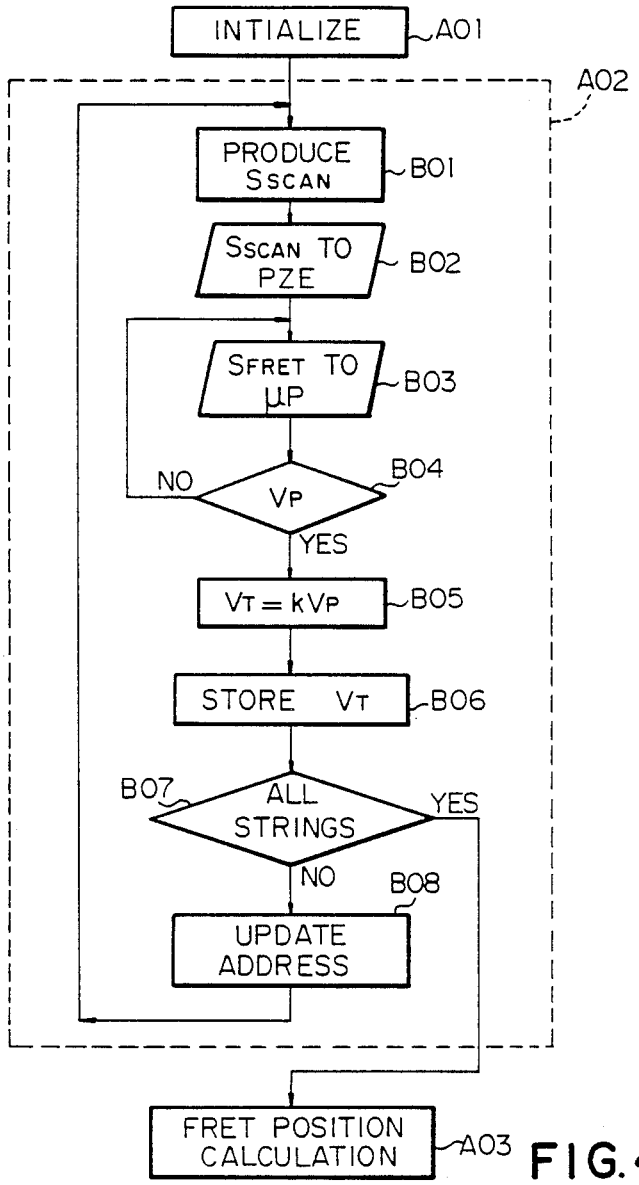
FIG. 4 is a flowchart showing the details of a threshold calculating subroutine program which may be executed to determine and store threshold values used in the routine program illustrated in FIG. 3, particularly in a fret-position detecting subroutine program thereof.

The threshold values used in the routine program, particularly in the fret-position detecting subroutine program A04 thereof are calculated by the microprocessor unit 46 in respect of the individual strings 16, respectively, and are stored in the memory area 50*a* of the RAM unit 50. Such threshold values $V_T$ are calculated in the threshold calculating subroutine program A02, the details of which are depicted in the flowchart of FIG. 4.

The execution of the threshold calculating subroutine program A02 is started upon termination of the initializing of the system as at step A01 of the main routine program described with reference to FIG. 3. In the threshold calculating subroutine program A02, a scan signal $S_{SCAN}$ consisting of a series of bits is output from the microprocessor unit 46 at step B01. The scan signal $S_{SCAN}$ is supplied through the I/O buffer 54 and wave separator circuit 38 to the piezoelectric transducer element 32 associated with a specified first one of the strings 16 at step B02. Supersonic vibrations are thus produced in the particular piezoelectric transducer element 32 and are transmitted through the associated string 16 to any one of the fret members 24. The vibrations which have reached one of the fret members 24 are reflected from the fret member 24 and are returned to the piezoelectric transducer element 32, which then generates an analog output signal $S_{FRET}$ in response to the supersonic vibrations thus received. The analog output signal $S_{FRET}$ from the piezoelectric transducer element 32 is passed through the wave separator circuit 38 to the A/D converter 40 and is converted by the A/D converter 40 into a succession of digital signals. As noted previously, the piezoelectric transducer element 32 receives the supersonic vibrations reflected from the bridge member 30 before the vibrations transmitted toward the fret member 24 are reflected therefrom.

The series of digital signals output from the A/D converter 40 is variable with the voltage of the signal $S_{FRET}$ input to the A/D converter 40 and is variable with the waveform of the vibrations received by the transducer element 32. Such digital signals are successively supplied to the microprocessor unit 46 of the data processor circuit 36 as at step B03, whereupon it is tested at step B04 by the microprocessor unit 46 whether or not the signals received is indicative of a peak value ($V_P$) of the voltage varying with the waveform of the vibrations received by the transducer element 32. While the voltage represented by the digital signals supplied to the microprocessor unit 46 is continuously varying, the answer for this step B04 is given in the negative and, thus, the microprocessor unit 46 repeats the loop of the steps B03 and B04 until the answer for the step B04 turns affirmative.

When it is confirmed at step B04 that the signal $S_{FRET}$ is indicative of a peak value $V_P$, then the microprocessor unit 46 proceeds to step B05 to calculate a threshold value ($V_T$) which corresponds to the detected peak value. Such a threshold value $V_T$ is calculated as a function of the detected peak value $V_P$ typically in the form of a product of the peak value $V_P$ multiplied by an appropriate constant (k) which is given experimentally. The threshold value $V_T$ thus determined on the basis of the detected peak value $V_P$ is stored at step B06 into the memory area 50a of the RAM unit 50 of the data processor circuit 36 at the address particularly assigned to the specified first one of the strings 16.

The step B06 is followed by a decision step B07 at which is tested whether or not there have been determined the threshold values for all the strings 16 which are herein assumed to be provided as six in number. If it is determined at this step B07 that there remains a threshold value to be determined for any other string 16, the address to be accessed in the memory area 50a of the RAM unit 50 during the next write cycle is incremented at step B08 and then the microprocessor unit 46 reverts to step B01 to repeat the loop of the steps B01 to B07 for another or specified second one of the strings 16. When it is confirmed at step B07 that threshold values have been determined and stored into the RAM unit 50 for all the strings 16, the answer for the step B07 is given in the affirmative so that the microprocessor unit 46 proceeds from the threshold calculating subroutine program A02 to the subsequent fret-position calculating subroutine program A03.

Figure 5:
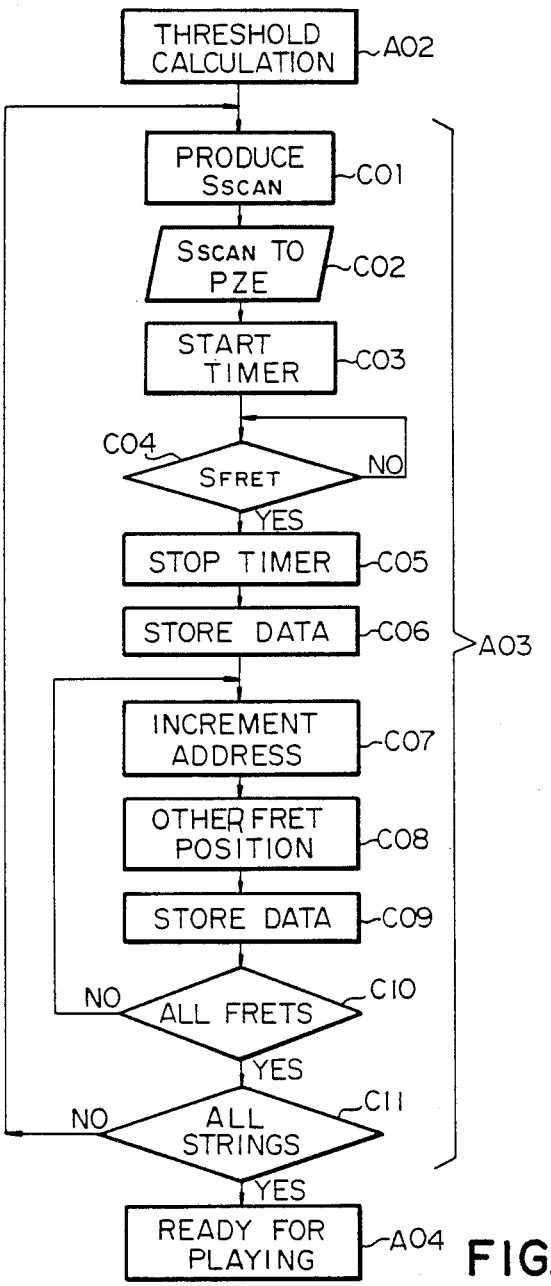
FIG. 5 is a flowchart showing the details of a fret-position calculating subroutine program which may be executed to produce and store fret position data used in the routine program illustrated in FIG. 3, also particularly in a fret-position detecting subroutine program thereof.

FIG. 5 shows the details of a fret-position calculating subroutine program which may be executed to produce the fret position data used in the fret-position detecting subroutine program A03 of the routine program illustrated in FIG. 3. As noted previously, the fret position data calculated by the microprocessor unit 46 are stored in the memory area 50b of the RAM unit 50.

The execution of the fret-position calculating subroutine program A03 is started subsequently to the threshold detecting subroutine program A02 of the main routine program described with reference to FIG. 3. Upon termination of the threshold detecting subroutine program A02, a scan signal $S_{SCAN}$ consisting of a series of bits is output from the microprocessor unit 46 at step C01. The scan signal $S_{SCAN}$ is supplied through the I/O buffer 54 and wave separator circuit 38 to the piezoelectric transducer element 32 associated with a specified first one of the strings 16 at step B02. In this instance, each of the strings 16 is disengaged from the fret members 24 except for a specified first one of the fret members 24 such as the fret member remotest from the fret-position detector assembly 28. Supersonic vibrations are thus produced in the particular piezoelectric transducer element 32 and are transmitted to the specified first one of the fret members 24 through the associated string 16. The vibrations which have reached the first one of the fret members 24 are reflected from the fret member 24 and are returned to the piezoelectric transducer element 32, which then generates an analog output signal $S_{FRET}$ in response to the supersonic vibrations thus received. The analog output signal $S_{FRET}$ from the piezoelectric transducer element 32 is passed through the wave separator circuit 38 to the A/D converter 40 and is converted by the A/D converter 40 into a succession of digital signals. The digital signals output from the A/D converter 40 are successively supplied to the microprocessor unit 46 of the data processor circuit 36 as at step C02. The steps C01 and C02 of the subroutine program A03 are thus similar to the steps B01 and B02, respectively, of the threshold calculating subroutine program A02 hereinbefore described with reference to FIG. 4.

A driving pulse $S_{DRV}$ is then issued from the microprocessor unit 46 the data processor circuit 36, whereupon the internal timer of the microprocessor unit 46 starts the counting of time at step C03 and continues the counting of time until the supersonic vibrations echoed from the specified first one of the fret members 24 are received by the piezoelectric transducer element 32 in which the supersonic vibrations originated. As noted previously, the vibrations which are received by the piezoelectric transducer element 32 contain not only the supersonic vibrations echoed from the fret member 24 but the spurious vibrations reflected from the bridge member 30 forming part of the fret-position detector assembly 28.

The analog electric signal $S_{FRET}$ produced by each of the piezoelectric transducer elements 32 is passed through the wave separator circuit 38 to the A/D converter 40. A series of digital signals is produced by the A/D converter 50 from the analog signals $S_{FRET}$ respectively output from the piezoelectric transducer elements 32 associated with the individual strings 16 are supplied in succession to the microprocessor unit 46 of the data processor circuit 36 through the I/O buffer 54. Until the supersonic vibrations transmitted from the piezoelectric transducer element 32 of the fret-position detector assembly 28 are reflected from the specified first one of the fret members 24 and are received by the transducer elements 32, the piezoelectric transducer element 32 is therefore responsive only to the vibrations echoed from the bridge member 30.

In response to each of the digital signals successively input through the I/O buffer 54, the microprocessor unit 46 tests at step C04 whether or not the vibrations received by the piezoelectric transducer element 32 are those which have been reflected from the first one of the fret members 24. For this purpose, the microprocessor unit 46 reads the threshold value stored in the memory area 50*a* of the RAM unit 50 in respect of the specified first one of the strings 16 and compares the data represented by the received digital signal with the threshold value thus read from the RAM unit 50. In the absence of any supersonic vibrations reflected from the fret member 24, the answer for the step C04 is given in the negative so that the microprocessor unit 46 repeats the step C04 until the answer for the step turns affirmative.

When it is found at step C04 that the supersonic vibrations transmitted to the first one of the fret members 24 are returned to and received by the piezoelectric transducer element 32, the internal timer of the microprocessor unit 46 ceases the counting of time at step C05 whereupon the microprocessor unit 46 calculates the period of time which has lapsed since the vibrations were initially generated in the piezoelectric transducer element 32. Then at step C06, the data thus produced as representing such a time interval is stored into the memory area 50*b* of the RAM unit 50 at the address assigned to the first one of the fret members and the first one of the strings 16. The step C06 is followed by a step C07 at which the address to be accessed in the memory area 50*b* of the RAM unit 50 during the next write cycle is incremented at step C07 and then the microprocessor unit 46 proceeds to step C08 at which the data produced as representing the time interval in respect of a specified second one of the fret members 24 is calculated by the microprocessor unit 46. The data thus determined for the second one of the fret members 24 is at step C09 stored into the memory area 50*b* of the RAM unit 50 at the address updated at step C07 and assigned to the second one of the fret members 24.

The step C09 is followed by a decision step C10 at which is tested whether or not there have been obtained the fretposition data for all the fret members 24 in regard to the first one of the strings 16. If it is determined at this step C10 that there remains a fret-position data to be obtained for any other fret member 24, the loop of the steps C07 to C10 is repeated until the answer for the step C10 is given in the affirmative. The microprocessor unit 46 then proceeds to step C11 to confirm whether or not there have been obtained the fret-position data for all the strings 16. If it is determined at this step C11 that there remains a fret-position data to be obtained for any other string 16, the loop of the steps C01 to C11 is repeated until the answer for the step C11 is given in the affirmative. When it is determined at step C11 that fret-position data have been obtained for all the string 16*s*, the microprocessor unit 46 proceeds from the fret-position calculating subroutine program A03 to the subsequent step A04 to indicate that the instrument is ready to operate.

Figure 6:
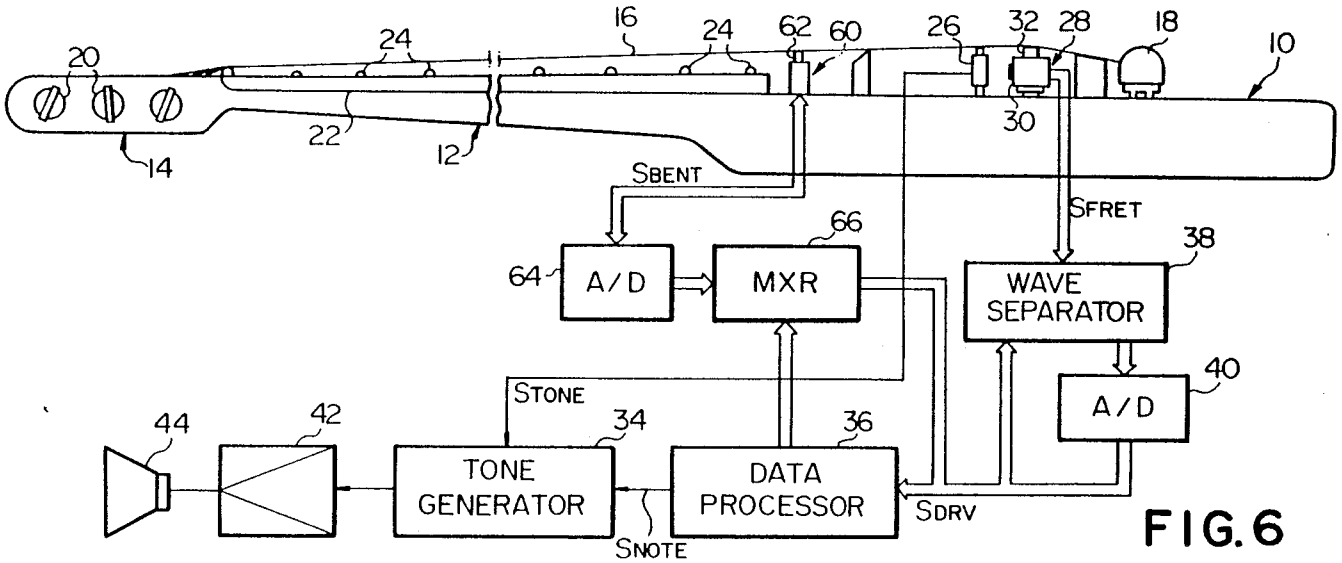
FIG. 6 is a view similar to FIG. 1 but now shows, in a side elevation view a second preferred embodiment of a fretted and stringed electronic musical instrument according to the present invention and in a block diagram of the general circuit arrangement of the control system incorporated in the musical instrument.

FIG. 6 shows a second preferred embodiment of the present invention provided by an electronic musical instrument having the previously described combined features of the two types of prior-art instruments.

Referring to FIG. 6, the musical instrument according to the second preferred embodiment of the present invention is assumed to be basically similar to the instrument described with reference to FIG. 1 and comprises the tone detector assembly 26 and the fret-position detector assembly 28. The tone detector assembly 26 is connected to the tone generator circuit 34 and the fret-position detector assembly 28 connected to the data processor circuit 36 through the wave separator 38 and A/D converter 40.

The musical instrument shown in FIG. 6 further comprises a unitary or single-piece bridge member 58 located intermediate between the tone detector assembly 26 and the fingerboard 22 and fixedly attached to the body portion 10 of the musical instrument. The bridge member 58 extends laterally of the body portion 10 of the instrument and is engaged by the individual strings 16 extending from the tone detector assembly 26 toward the fingerboard 22.

The musical instrument shown in FIG. 6 further comprises a bent-string sensor assembly 60 located intermediate between the bridge member 58 and the fingerboard 22 and fixedly attached in its entirety to the body portion 10 of the musical instrument. The bent-string sensor assembly 60 includes a plurality of probe elements 62 respectively engaged by the individual strings 16 of the instrument. On the body portion 10 of the musical instrument are thus provided the tailpiece 18, fret-position detector assembly 28, tone detector assembly 26, bridge member 58 and bent-string sensor assembly 60 which are arranged in this sequence from the end of the body portion 10 toward the fingerboard 22 as shown.

As in the electrical arrangement of the musical instrument described with reference to FIG. 1, the tone detector assembly 26 is composed of pickup elements respectively associated with the strings 16 and adapted to produce signals $S_{TONE}$ when the respectively associated strings 16 are picked individually. The signals $S_{TONE}$ thus generated by the tone detector assembly 26 are supplied to the tone generator circuit 34 to enable the tone generator circuit 34 to generate musical tone signals in response to the signals $S_{TONE}$. To each of the piezoelectric transducer elements 32 of the detector assembly 28 is supplied a succession of driving pulses $S_{DRV}$ from the data processor circuit 36 through the wave separator circuit 38. In response to each of these driving pulses $S_{DRV}$, each of the piezoelectric transducer elements 32 of the detector assembly 28 generates vibrations of a predetermined supersonic frequency within a range of from 400 KHz to 450 KHz as previously noted. The supersonicfrequency vibrations generated by each piezoelectric transducer element 32 are transmitted through the string 16 engaged by the transducer element 32 and via the bridge member 58 and bent-string sensor assembly 60 to the fret member 24 against which the particular string 32 is currently pressed. The vibrations which have reached the fret member 24 are then reflected backwardly from the fret member 24 to the piezoelectric transducer element 32 via the bent-string sensor assembly 60 and bridge member 58 and enable the piezoelectric transducer element 32 to produce an electric signal $S_{FRET}$ when the vibrations transmitted backwardly through the string 16 reach the piezoelectric transducer element 32. In the electrical arrangement of the musical instrument according to the second preferred embodiment of the present invention, the bent-string sensor assembly 60 is connected through an A/D converter 64 and a multiplexer 66 to the data processor circuit 36. The functions of these A/D converter 64 and multiplexer 66 will be described later.

The unitary bridge member 58 located intermediate between the tone detector assembly 26 and bent-string sensor assembly 60 as above described is adapted to pass supersonicfrequency vibrations of the strings 16 from the piezoelectric transducer elements 32 of the fret-position detector assembly 28 to the bent-string sensor assembly 60 without damping and reflecting the vibrations. In response to the low-frequency vibrations produced in the strings 16 when the strings 16 are picked by the instrument player's fingers or fingernails, the bridge member 58 dampens out such low-frequency vibrations and isolates the vibrations from the bent-string sensor assembly 60. The bridge member 58 is further effective to take up lateral displacement of the strings 16 to prevent such displacement from being transmitted to the bent-string sensor assembly 60. The bridge member 58 to achieve these functions is formed typically of acrylonitrile-butadiene-styrene (ABS) copolymer.

Each of the probe elements 62 of the bent-string sensor assembly 60 is rockably supported on a pivot shaft fixed with respect to the body portion 10 of the instrument and has a lower portion movably located between a light emitter element and a photoelectric transducer constituting a photocoupling unit, though not shown in the drawings. The light emitter element may be implemented by a light emitting diode and the photoelectric transducer element implemented by a photodiode. Each probe element 62 is engaged at its upper end with one of the strings 16 and is thus forced to turn on the pivot shaft when the associated string 16 is caused to sidewise slide on the fret member 24 with which the string 16 is held in contact. With the probe element 62 thus turned about the axis of the pivot shaft, the sectional area of the path of light from the light emitter element toward the photoelectric transducer element of the photocoupling unit varies with the angle of turn of the probe element. This results in a change in the quantity of light incident on the photoelectric transducer element and, accordingly, the photocoupling unit produces an analog electric signal $S_{BENT}$ which is variable with the angle of turn of the probe element and thus the amount of lateral displacement of the string 16 on the fret member 24. The analog signal $S_{BENT}$ supplied from the photocoupling unit is supplied to the multiplexer 66 after being digitalized by the A/D converter. For further details of the bent-string sensor assembly 60, reference may be made to Japanese patent application no. 62-083289.

Figure 7:
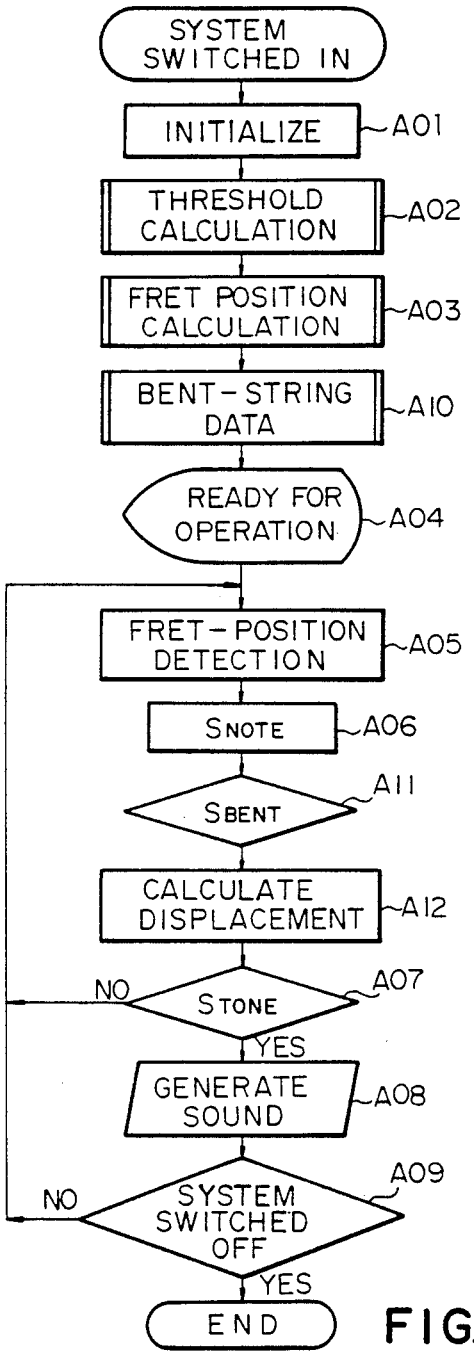
FIG. 7 is a flowchart showing a main routine program which may be executed to achieve the major function of the second preferred embodiment of an electronic musical instrument according to the present invention.

A routine program which may be executed by the microprocessor unit 46 to achieve the major function of the electronic musical instrument according to the second preferred embodiment of the present invention as above described is shown in the flowchart of FIG. 7. The routine program herein shown includes all the steps of the program described with reference to FIG. 3 and additionally has an initial bent-string data forming subroutine program A10 which intervenes between the subroutine program A03 and step A04 and steps A11 and A12 which intervene between the steps A06 and A07 of the routine program illustrated in FIG. 3. The initial bent-string data forming subroutine program A10 is executed to provide data relating to the amount of displacement of a bent string as will be described in more detail with reference to FIG. 8.

After the sound note signal $S_{NOTE}$ produced by the microprocessor unit 46 is output from the data processor circuit 36 to the tone generator circuit 34 through the I/O buffer 54 at step A06, the microprocessor unit 46 supplies to the multiplexer 66 an address signal assigned to each of the photocoupling units of the bent-string sensor assembly 62 to read data output from the multiplexer 66. It is then tested at the additional step A11 whether or not the signal $S_{BENT}$ is contained in the data output from the multiplexer 66 and originating in any of the photocoupling units of the bent-string sensor assembly 60. If it is found at this step A11 that there is present the signal $S_{BENT}$ in regard to any of the strings 16, the microprocessor unit 46 calculates the amount of lateral displacement of the string 16 from the signal $S_{BENT}$ and transmits data representative of the amount of displacement to the tone generator circuit 34 through the I/O buffer 54 at step A12. It is thereafter tested at step A07 whether or not there is the signal $S_{TONE}$ supplied from the tone detector assembly 26 to the tone generator circuit 34 as previously described with reference to FIG. 3.

Figure 8:
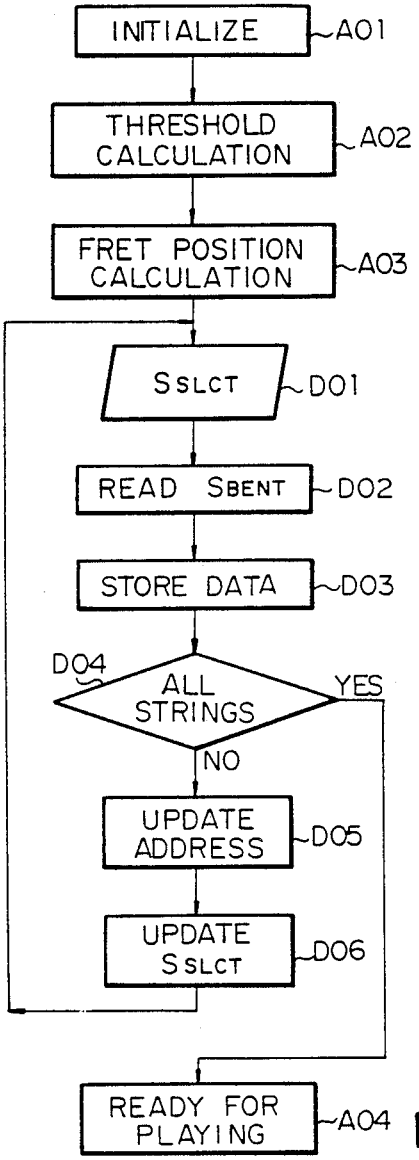
FIG. 8 is a flowchart showing the details of an initial bent-string data forming subroutine program which may be executed in the routine program illustrated in FIG. 7.

Turning to FIG. 8, the initial bent-string data forming subroutine program A10 is executed subsequently to the fret-position calculating subroutine program A03 to provide data relating to the amount of displacement of a bent string. Such a subroutine program A10 starts with a step D01 at which a string select signal $S_{SLCT}$ is supplied from the microprocessor unit 46 of the data processor circuit 36 to the multiplexer 66 through the I/O buffer 54*a* to select a specified first one of the strings 16. A signal $S_{BENT}$ is then output from the photocoupling unit associated with the selected string 16 with the string maintained in a non-bent state of the string 16 and is, after being digitalized by the A/D converter 64, passed to the multiplexer 66. The step D01 is followed by a step D02 at which the microprocessor unit 46 reads the data thus supplied to the multiplexer 66 and is stored at subsequent step D03 into a predetermined memory area (not shown) of the RAM unit 50 at the address particularly assigned to the specified first one of the strings 16.

The step D03 is followed by a decision step D04 at which it is tested whether or not the data relating to the non-bent states of all the strings 16 have been stored into the RAM unit 50. If it is determined at this step B07 that there remains data to be obtained for any other string 16, the address to be accessed in the RAM unit 50 during the next write cycle is incremented at step D05 and then the string select signal $S_{SLCT}$ from the microprocessor unit 46 is updated to select another string 16. The microprocessor unit 46 then reverts to step D01 to repeat the loop of the steps D01 to D06 for another string 16. When it is confirmed at step D04 that the data for all the strings 16 have been stored into the RAM 50, the answer for the step D04 is given in the affirmative so that the microprocessor unit 46 proceeds from the initial bent-string data forming subroutine program A04 to the subsequent step A04 of the main routine program illustrated in FIG. 7.

What is claimed is:

1. An electronic musical instrument having a parameter adjustment mode and a playing mode of operation, comprising (a) a plurality of fret members located at predetermined spacings;

(b) a string stretched over said fret members so that a player's depression of the string causes contact between the string and at least one of said fret members, (c) vibration generating and receiving means for producing supersonic vibrations having a variable waveform in said string and receiving the supersonic vibrations reflected from any of said fret members through said string, the supersonic vibrations transmitted from said vibration generating and receiving means being reflected from a fret member contacted by said string, so that said vibration generating and receiving means detect transmitting characteristics of said string when a parameter adjustment mode is selected;

(d) data forming means for forming data representing said transmitting characteristics of said string; and (e) fret position detecting means responsive to said data supplied by said data forming means for detecting said fret member contacted by said string when a playing mode of operation is selected.

* * * * *